US011432062B2

(12) United States Patent
Chen et al.

(10) Patent No.: US 11,432,062 B2
(45) Date of Patent: Aug. 30, 2022

(54) BONE CONDUCTION EARPHONE

(71) Applicant: LUXSHARE PRECISION INDUSTRY CO., LTD., Shenzhen (CN)

(72) Inventors: Si Chen, Hong Kong (CN); Zhenhua Liu, Hong Kong (CN)

(73) Assignee: LUXSHARE PRECISION INDUSTRY CO., LTD., Guangdong (CN)

( * ) Notice: Subject to any disclaimer, the term of this patent is extended or adjusted under 35 U.S.C. 154(b) by 64 days.

(21) Appl. No.: 17/096,604

(22) Filed: Nov. 12, 2020

(65) Prior Publication Data

US 2022/0007098 A1 Jan. 6, 2022

(30) Foreign Application Priority Data

Jul. 2, 2020 (CN) ..... 202010633900.5

(51) Int. Cl.
*H04R 1/10* (2006.01)

(52) U.S. Cl.
CPC ..... *H04R 1/10* (2013.01); *H04R 2460/13* (2013.01)

(58) Field of Classification Search
CPC ..... H04R 25/606; H04R 25/652; H04R 2460/13; H04R 2225/67; H04R 11/00; H04R 17/00; H04R 1/14; H04R 1/46; H04R 1/1016; H04R 1/1058; H04R 1/105;

(Continued)

(56) References Cited

U.S. PATENT DOCUMENTS

2009/0245556 A1* 10/2009 Parker ..... H04R 25/70 381/326
2014/0056459 A1 2/2014 Oishi (Continued)

FOREIGN PATENT DOCUMENTS

CN 204669581 U * 9/2015 ..... H04R 1/10
CN 105794223 A 7/2016
CN 205454089 U 8/2016

(Continued)

OTHER PUBLICATIONS

Netherlandish Search Report and Written Opinion for Netherlandish Application No. 2027833, dated Jun. 28, 2021.

(Continued)

*Primary Examiner* — Ahmad F. Matar
*Assistant Examiner* — Sabrina Diaz
(74) *Attorney, Agent, or Firm* — Birch, Stewart, Kolasch & Birch, LLP

(57) ABSTRACT

Provided is a bone conduction earphone that includes a main body, and a bone conduction speaker and a passive radiator that are mounted on the main body. The passive radiator is connected to the bone conduction speaker through a connecting rod. When vibrating by being excited by an audio signal, the bone conduction speaker drives the passive radiator to vibrate synchronously through the connecting rod. The passive radiator and the bone conduction speaker cooperate with each other to form a multi-vibration system, thereby effectively enhancing the quality of vibration, improving the effect of sound field radiation, and improving the frequency response, especially remedying the deficiencies in low-frequency response.

8 Claims, 9 Drawing Sheets

(58) Field of Classification Search
CPC ..... H04R 1/1066; H04R 1/1008; H04R 1/10; H04R 2201/107; H04R 2420/07
USPC ..... 381/151, 380, 381, 326
See application file for complete search history.

(56) References Cited

U.S. PATENT DOCUMENTS

| | | | | |
|---|---|---|---|---|
| 2016/0234588 | A1* | 8/2016 | Timothy | H04R 1/26 |
| 2021/0076121 | A1* | 3/2021 | Sha | H04R 1/105 |

FOREIGN PATENT DOCUMENTS

| | | | | | |
|---|---|---|---|---|---|
| CN | 107005759 | A1 | | 8/2017 | |
| CN | 207612396 | U | | 7/2018 | |
| CN | 209488778 | U | * | 10/2019 | H04R 1/10 |
| CN | 209526843 | U | * | 10/2019 | H04R 1/10 |
| CN | 210491167 | U | | 5/2020 | |
| EP | 3 054 702 | A1 | | 8/2016 | |
| JP | 2003-32772 | A | | 1/2003 | |
| JP | 2011-119913 | A | | 6/2011 | |
| WO | WO 2008/014498 | A2 | | 1/2008 | |
| WO | WO 2015/109002 | A1 | | 7/2015 | |
| WO | WO 2019/105567 | A1 | | 6/2019 | |
| WO | WO 2019/142461 | A1 | | 7/2019 | |

OTHER PUBLICATIONS

Chinese Office Action and Search Report for Chinese Application No. 202010633900.5, dated Apr. 12, 2021, with English translation.

* cited by examiner

BONE CONDUCTION EARPHONE

CROSS-REFERENCE TO RELATED APPLICATIONS

This application claims the priority of China patent application No. 202010633900.5 filed on Jul. 2, 2020, disclosure of which is hereby incorporated by reference in its entirety.

TECHNICAL FIELD

The present disclosure relates to the technical field of earphones and, in particular to a bone conduction earphone.

BACKGROUND

Compared with an ordinary earphone, a bone conduction earphone transmits sound waves through the skull, bony labyrinth, inner ear lymph, spiral organ, auditory nerve, and auditory center of a human body. Compared with the sound wave conduction method of the ordinary earphone, the bone conduction earphone saves multiple steps of sound wave transmission in operation. Thus, the bone conduction earphone is able to avoid external interference and reproduce a clear sound in a noisy environment. Furthermore, the sound waves will not spread in the air and affect others.

However, limited and affected by factors such as technology and wearing style, the existing bone conduction earphone typically uses a single bone conduction speaker to implement sound transmission. Such design results in significant sound leakage earphone, a poor sound field effect, and some inferior frequency bands of the bond conduction earphone, in particular, noticeable defects in quality and quantity of low frequencies, thereby affecting the user experience.

SUMMARY

An object of the present disclosure is to provide a bone conduction earphone, which forms a multi-vibration system without increasing power consumption, thereby effectively enhancing the quality of vibration, improving the effect of sound field radiation and improving the frequency response.

There is provided a bone conduction earphone that includes a main body, a bone conduction speaker mounted on the main body and a passive radiator. The passive radiator is mounted on the main body and is connected to the bone conduction speaker through a connecting rod. When the bone conduction speaker is excited by an audio signal to vibrate, the passive radiator is capable of being driven to vibrate synchronously through the connecting rod.

In some embodiments, a plurality of passive radiators are disposed around the bone conduction speaker, each passive radiator is connected to the bone conduction speaker through one connecting rod.

In some embodiments, the passive radiators are provided in an even number, every two of the passive radiators and are disposed symmetrically as a set about the bone conduction speaker. Two ends of each connecting rod are connected to a corresponding set of the two passive radiators, respectively, and the center of the each of the connecting rod is connected to the bone conduction speaker.

In some embodiments, the main body includes a base and a hook. The bone conduction speaker and the passive radiator are each mounted on the base. The hook is detachably connected to the base and is capable of being hooked on the periphery of a human ear and cooperating with the bone conduction speaker to clamp the human ear.

In some embodiments, of the hook and the base, one is provided with an insertion slot and a seizing hole passing through the side wall of the insertion slot, and the other is provided with an insertion rod and a locking protrusion connected to the outer wall of the insertion rod. The insertion rod is inserted in the insertion slot, and the locking protrusion is caught in the seizing hole.

In some embodiments, the opening of the insertion slot is provided with a limiting slot passing through the side wall of the insertion slot, and the outer wall of the insertion rod is connected to a limiting protrusion. The limiting protrusion is inserted in the limiting slot.

In some embodiments, the base includes a bottom housing and an cover. The opening of the bottom housing faces away from the hook, the cover is connected to the bottom housing and covers the opening of the bottom housing. The bottom housing is provided with an active acoustic aperture and a passive acoustic aperture, the bone conduction speaker is mounted in the active acoustic aperture and the passive radiator is mounted in the passive acoustic aperture.

In some embodiments, the hook is rod-shaped and includes a first arc segment and a second arc segment connected to each other. The free end of the first arc segment is connected to the base. The first arc segment is bent toward the base and is capable of being hooked on the periphery of the human ear. The second arc segment is bent away from the base, and the outer side surface of the second arc segment abuts against the bone conduction speaker.

In some embodiments, the main body also includes a cushion strip, which is connected to the hook and extends from the inner side surface of the first arc segment to the outer side surface of the second arc segment. The first arc segment is hooked on the periphery of the human ear through the cushion strip.

In some embodiments, the main body also includes a cushion sleeve sleeved on the second arc segment. The outer side surface of the second arc segment abuts against the bone conduction speaker through the cushion sleeve.

TABLE OF REFERENCE SIGNS

Figure 1:
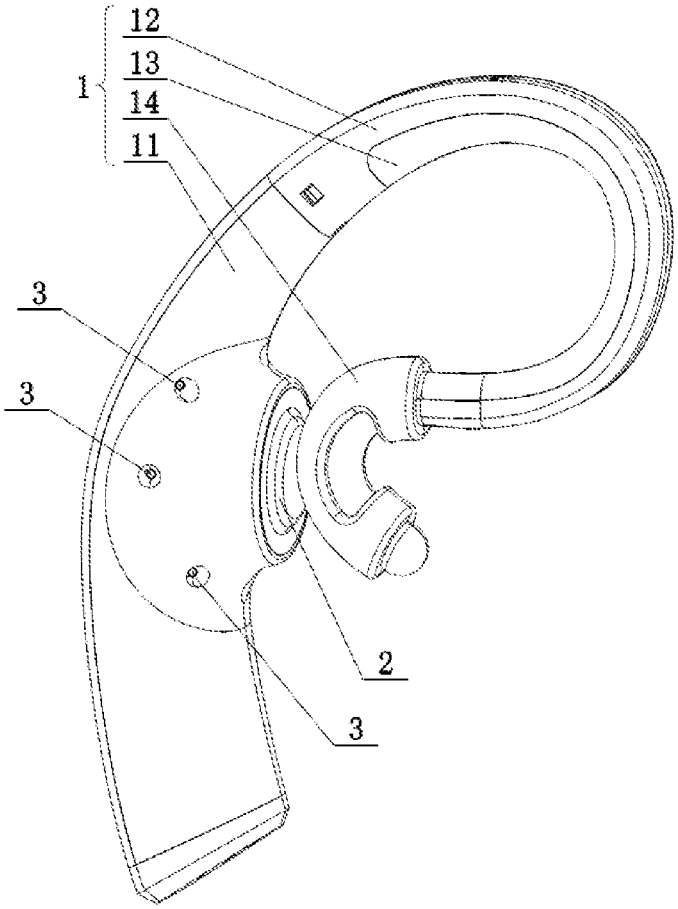
FIG. 1 is a schematic view illustrating the structure of a bone conduction earphone according to an embodiment of the present disclosure.
Figure 2:
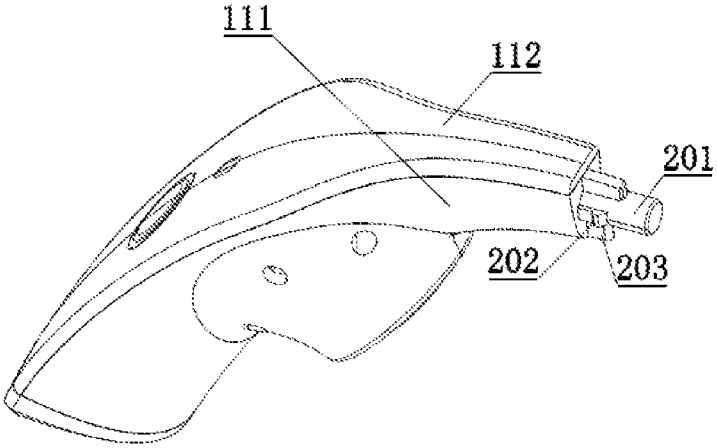
FIG. 2 is a schematic view illustrating the structure of the bone conduction earphone of FIG. 1 viewed from an orientation omitting the hook, cushion strip, and cushion sleeve.
Figure 3:
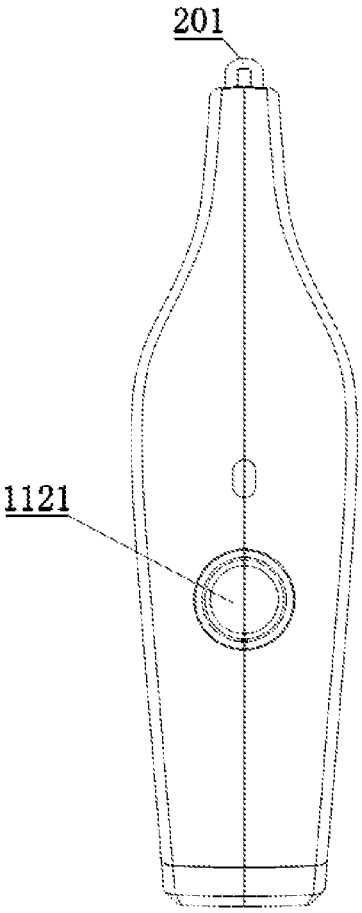
FIG. 3 is a schematic view illustrating the structure of the rear outer side of the bone conduction earphone of FIG. 1 omitting the hook, cushion strip, and cushion sleeve.
Figure 4:
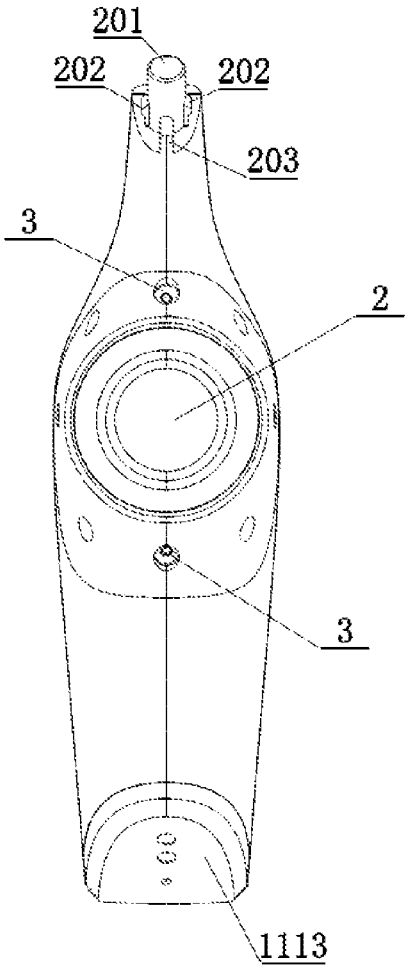
FIG. 4 is a schematic view illustrating the structure of the rear inner side of the bone conduction earphone of FIG. 1 omitting the hook, cushion strip, and cushion sleeve.
Figure 5:
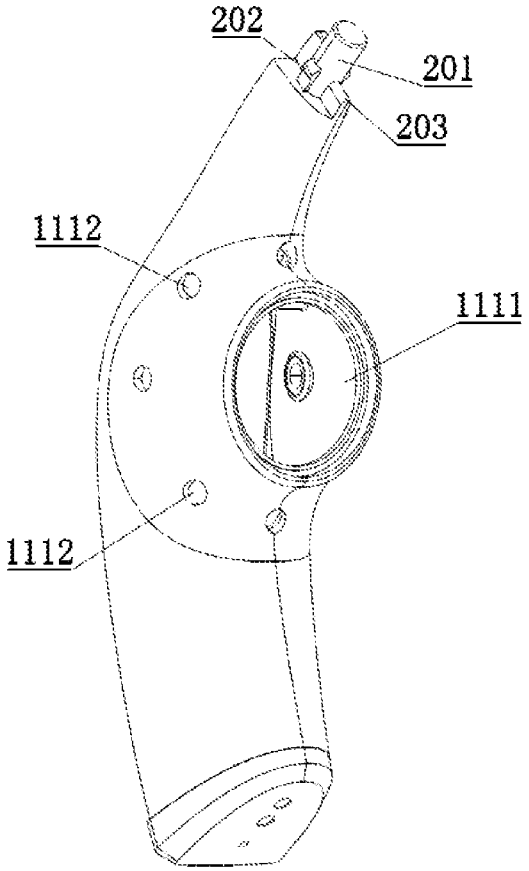
FIG. 5 is a schematic view illustrating the structure of a bottom housing of the bone conduction earphone of FIG. 1.

| | |
|---|---|
| 100. Connecting rod | 1. Main body |
| 11. Base | 111. Bottom housing |
| 1111. Active acoustic aperture | 1112. Passive acoustic aperture |
| 1113. Charging terminals | 112. Cover |
| 1121. Control button | 12. Hook |
| 121. First arc segment | 122. Second arc segment |
| 13. Cushion strip | 14. Cushion sleeve |
| 2. Bone conduction speaker | 3. Passive radiator |
| 101. Insertion slot | 102. Seizing hole |
| 103. Limiting slot | 201. Insertion rod |
| 202. Locking protrusion | 203. Limiting protrusion |

DETAILED DESCRIPTION

The embodiments of the present disclosure are described in detail below, and examples of the embodiments are illustrated in the drawings, where the same or similar reference numerals indicate the same or similar elements or elements having the same or similar functions. The embodiments described below with reference to the drawings are exemplary and intended to illustrate the present disclosure and are not to be construed as limiting the present disclosure.

In the description of the present disclosure, terms "joined to/with", "connected to/with" and "secured to/with" are to be understood in a broad sense unless otherwise expressly specified and defined. For example, the term "connected to/with" may refer to "securely connected to/with" or "detachably connected to/with", may refer to "mechanically connected to/with" or "electrically connected to/with" or may refer to "directly connected to/with", "indirectly connected to/with through an intermediary" or "two components are internally connected to each other" or "interaction between two components". For those of ordinary skill in the art, specific meanings of the preceding terms in the present disclosure may be understood depending on the context.

In the present disclosure, unless otherwise expressly specified and defined, when a first feature is described as "on" or "below" a second feature, the first feature and the second feature may be in direct contact or may be in contact via another feature between the two features instead of being in direct contact. Furthermore, when the first feature is described as "on", "above" or "over" the second feature, the first feature is right on, above or over the second feature or the first feature is obliquely on, above or over the second feature, or the first feature is simply at a higher level than the second feature. When the first feature is described as "under", "below" or "underneath" the second feature, the first feature is right under, below or underneath the second feature or the first feature is obliquely under, below or underneath the second feature, or the first feature is simply at a lower level than the second feature.

In the related art, a passive radiator is usually used in audio device. An audio that uses a passive radiator usually includes an active speaker unit and a passive unit (that is the passive radiator). In the audio, except that there is no voice coil and driving magnet, the passive unit is usually similar in appearance to the active speaker unit. Inside the audio device, the passive unit is driven by the air in the cabinet to make passive sound to adjust the sound quality of the smaller cabinet, thereby making the smaller cabinet have better bass performance.

The solution of the present disclosure is further described in conjunction with drawings and embodiments.

As illustrated in FIGS. 1 to 13, the present disclosure provides a bone conduction earphone, which includes a main body 1, a bone conduction speaker 2, and a passive radiator 3. In the bone conduction earphone, the main body 1 can be hooked on the external auricle of a human ear, the bone conduction speaker 2 is mounted on the main body 1 and is capable of transmitting sound waves against the human ear. The passive radiator 3 is mounted on the main body 1, and is connected to the bone conduction speaker 2 through a connecting rod 100. When the bone conduction speaker 2 is excited by an audio signal to vibrate, the passive radiator 3 is capable of being driven to vibrate synchronously through the connecting rod 100.

In the present disclosure, the passive radiator 3 cooperates with the bone conduction speaker 2 to form a multi-vibration system, which effectively enhances the vibration quality, improves the sound field radiation effect and the frequency response, especially the lack of low-frequency response. The passive radiator 3 and the bone conduction speaker 2 are connected through the connecting rod 100, thus the bone conduction speaker 2 is capable of driving the passive radiator 3 to vibrate synchronously without additional power consumption. By the transmission of the connecting rod 100, the vibration synchronization of the passive radiator 3 and the bone conduction speaker 2 is implemented in a simple and efficient manner. Thus, the amplitude-frequency response is improved, and a consistent phase response is effectively guaranteed.

In this embodiment, both the bone conduction speaker 2 and the passive radiator 3 are conventional components in the field, and their specific structure and working principles will not be repeated here. In addition, the connecting rod 100 may be a conventional rod-shaped structure of plastic material, which is used for connecting the bone conduction speaker 2 to the passive radiator 3.

In some embodiments, a plurality of passive radiators 3 are provided and the passive radiators 3 are disposed around the bone conduction speaker 2, and each passive radiator 3 is connected to the bone conduction speaker 2 through one connecting rod 100.

Figure 11:
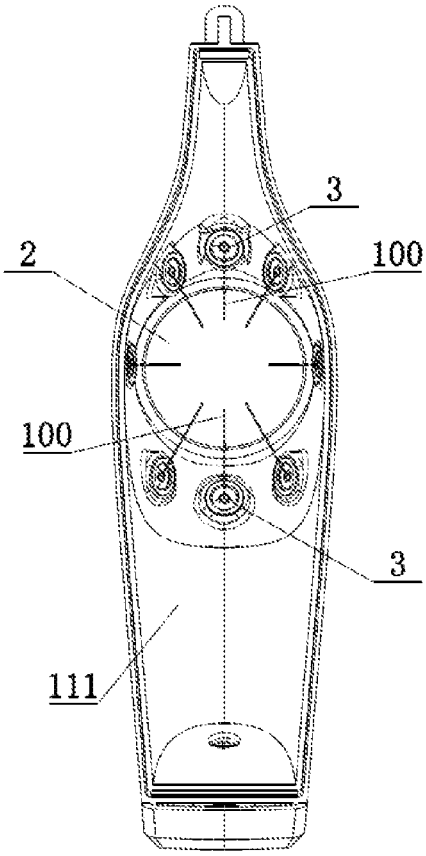
FIG. 11 is a schematic view illustrating the structure for mounting of the bone conduction speaker and the passive radiators of the bone conduction earphone on the bottom housing according to another embodiment of the present disclosure.
Figure 13:
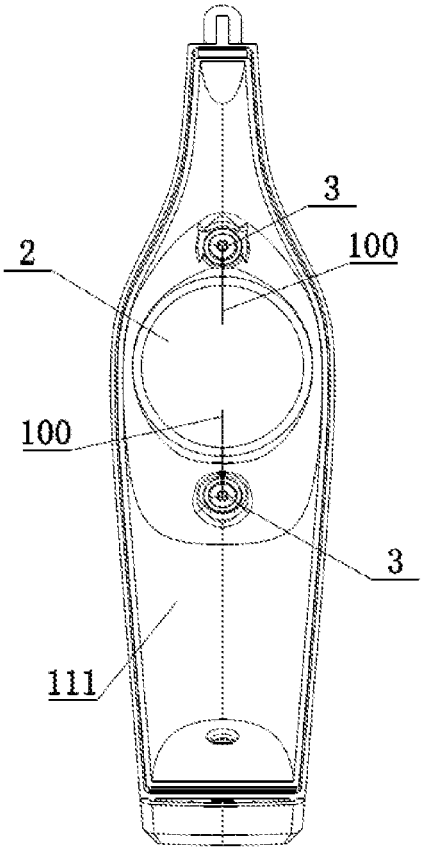
FIG. 13 is a schematic view illustrating the structure in which the bone conduction speaker and the passive radiators are mounted on the bottom housing in the bone conduction earphone according to yet another embodiment of the present disclosure.

Specifically, as illustrated in FIG. 11, eight passive radiators 3 are disposed around the bone conduction speaker 2 and connected to the bone conduction speaker 2 through eight connecting rods 100. As illustrated in FIG. 13, the two passive radiators 3 are located on opposite sides of the bone conduction speaker 2, and the two passive radiators 3 are connected to the bone conduction speaker 2 through two connecting rods 100.

Alternatively, the passive radiator 3 is provided in an even number. Every two passive radiators 3 as a set and are disposed symmetrically with respect to the bone conduction speaker 2. The two ends of each connecting rod 100 are respectively connected to two passive radiators 3 of a set, and the center of each connecting rod 100 is connected to the bone conduction speaker 2.

Figure 10:
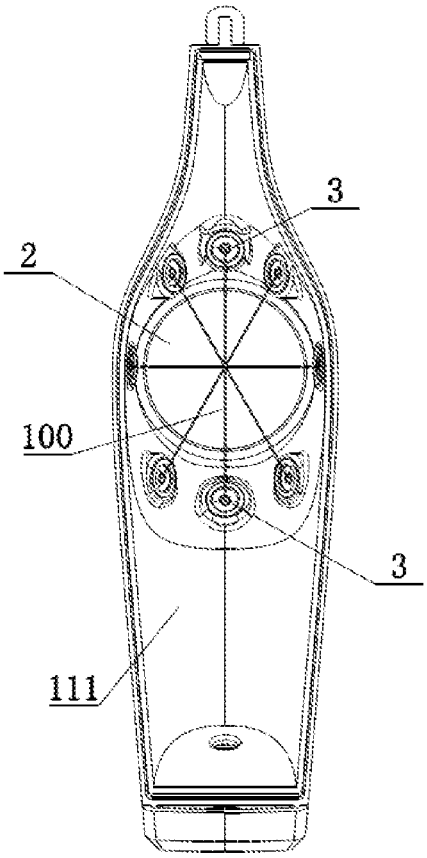
FIG. 10 is a schematic view illustrating the structure in which the bone conduction speaker and the passive radiators are mounted on the bottom housing in the bone conduction earphone of FIG. 1.
Figure 12:
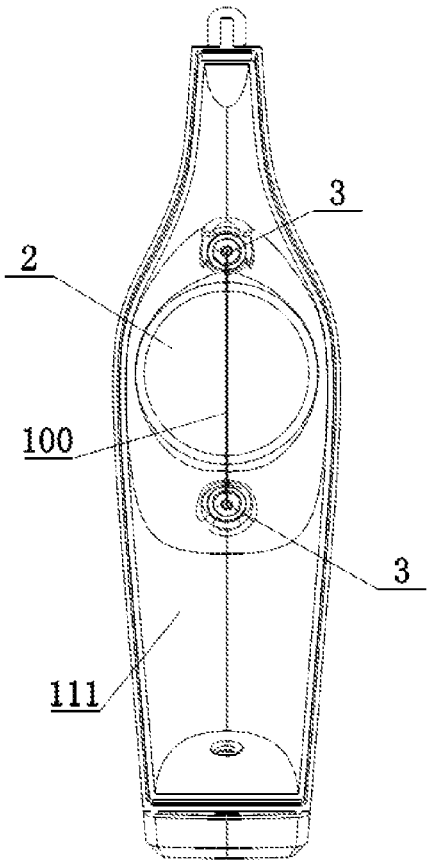
FIG. 12 is a schematic view illustrating the structure in which the bone conduction speaker and the passive radiators are mounted on the bottom housing in the bone conduction earphone according another embodiment of the present disclosure.

Specifically, as illustrated in FIG. 10, eight passive radiators 3 are disposed around the bone conduction speaker 2 and the passive radiators 3 are divided into four sets in pairs. The four sets of passive radiators 3 are connected to the bone conduction speaker 2 through four connecting rods 100. The four connecting rods 100 are cross-folded at the central axis of the bone conduction speaker 2 and then connected to the bone conduction speaker 2. As illustrated in FIG. 12, the two passive radiators 3 are located on opposite sides of the bone conduction speaker 2, and the two passive radiators 3 are connected to the bone conduction speaker 2 through one connecting rod 100, and the two connecting rods 100 are connected to the bone conduction speaker 2 after being cross-folded at the central axis of the bone conduction speaker 2.

In some embodiments, the main body 1 includes a base 11 and a hook 12. In the main body 1, the bone conduction speaker 2 and the passive radiator 3 are respectively mounted on the base 11. The hook 12 is detachably connected to the base 11 and can be hooked on the periphery of the human ear, specifically the periphery of the auricle, thereby being matched with the bone conduction speaker 2 to clamp the human ear, specifically the cartilage on the auricle. The above arrangement facilitates the replacement of hooks 12 of different sizes according to the user's usage habits and comfort.

Specifically, for both the hook 12 and the base 11, one is provided with an insertion slot 101 and a seizing hole 102 passing through the side wall of the insertion slot 101, and the other is provided with an insertion rod 201 and a locking protrusion 202 connected to the outer wall of the insertion rod 201. The insertion rod 201 is inserted in the insertion slot 101, and the locking protrusion 202 is caught in the seizing hole 102. The above arrangement makes the connection between the hook 12 and the base 11 safer and securer on the basis of being easy to disassemble.

Figure 6:
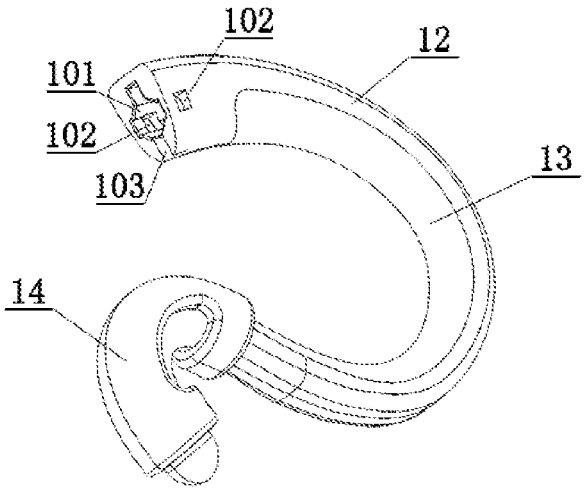
FIG. 6 is a schematic view illustrating the structure of the hook, the cushion strip and the cushion sleeve fitted with each other in the bone conduction earphone of FIG. 1.
Figure 7:
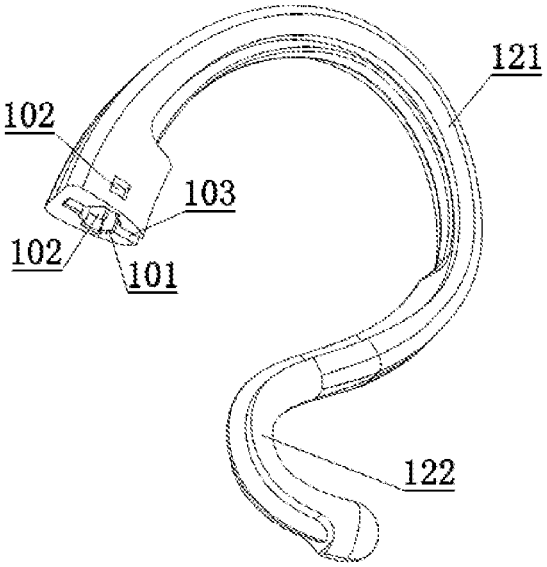
FIG. 7 is a schematic view illustrating the structure of the hook of the bone conduction earphone of FIG. 1.
Figure 8:
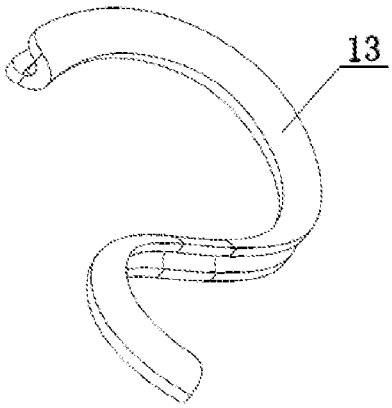
FIG. 8 is a schematic view illustrating the structure of the cushion strip of the bone conduction earphone of FIG. 1.
Figure 9:
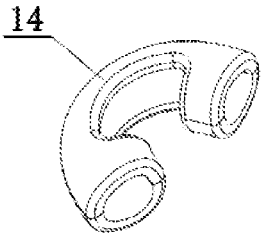
FIG. 9 is a schematic view illustrating the structure of the cushion sleeve of the bone conduction earphone of FIG. 1.

In this embodiment, as illustrated in FIGS. 2 to 5, the insertion rod 201 and the locking protrusion 202 connected to the outer wall of the insertion rod 201 are disposed on the base 11. In the base 11, two locking protrusions 202 are disposed on opposite sides of the insertion rod 201. As illustrated in FIG. 6, the insertion slot 101 and the seizing hole 102 passing through the side wall of the insertion slot 101 are disposed on the hook 12. In the hook 12, two seizing holes 12 are disposed on opposite sides of the insertion slot 101.

More specifically, the slot of the insertion slot 101 is also provided with a limiting slot 103 passing through the side wall of the insertion slot 101, and the outer wall of the insertion rod 201 is connected to a limiting protrusion 203 which is inserted in the limiting slot 103. The above arrangement has a fool-proof effect, thus preventing the occurrence of the situation where the hook 12 and the base 11 are opposite in orientation when they are fitted together.

In some embodiments, the base 11 includes a bottom housing 111 and a cover 112, and the opening of the bottom housing 111 is away from the hook 12. The bottom housing 111 is provided with an active acoustic aperture 1111 and a passive acoustic aperture 1112. The bone conduction speaker 2 is mounted in the active acoustic aperture 1111 and the passive radiator 3 is mounted in the passive acoustic aperture 1112. When a plurality of passive radiators 3 are provided, a plurality of passive acoustic apertures 1112 will be provided so as to correspond to the passive radiators 3 respectively, and each passive radiator 3 is mounted in one passive acoustic aperture 1112.

In this embodiment, the insertion rod 201, the locking protrusion 202 and the limiting protrusion 203 are all disposed on one end of the bottom housing 111, and the other end of the bottom housing 111 is provided with charging terminals 1113. External devices can charge a power supply in the bottom housing 111 by the charging terminals 1113. The outside of the cover 112 is provided with a control button 1121, which is electrically connected to a circuit board in the bottom housing 111, and can control ON-OFF of the bone conduction earphone.

Specifically, the hook 12 is rod-shaped and includes a first arc segment 121 and a second arc segment 122 connected to each other and the free end of the first arc segment 121 is connected to the base 11. The first arc segment 121 is bent toward the base 11 and can be hooked on the periphery of the human ear. The second arc segment 122 is bent away from the base 11, and the outer side surface of the second arc segment 122 abuts against the bone conduction speaker 2. When a user wears the bone conduction earphone, the first arc segment 121 is hooked around the auricle, and the second arc segment 122 cooperates with the bone conduction speaker 2 to clamp the cartilage behind the auricle. Thus, the bone conduction earphone can be worn more securely so that it is not easy to drop when in use.

Specifically, the main body 1 also includes a cushion strip 13, which is connected to the hook 12 and extends from the inner side surface of the first arc segment 121 to the outer side surface of the second arc segment 122. The first arc segment 121 is hooked on the periphery of the human ear through the cushion strip 13. The cushion strip 13 is made of soft materials such as rubber and thus is comfortable for the user to wear.

In this embodiment, the hook 12 is provided with a locking groove, which extends from the inner side surface of the first arc segment 121 to the outer side surface of the second arc segment 122. The cushion strip 13 is inserted in the locking groove and thus can be easily disassembled, cleaned and maintained.

More specifically, the main body 1 also includes a cushion sleeve 14, which is sleeved on the second arc segment 122. The outer side surface of the second arc segment 122 abuts against the bone conduction speaker 2 through the cushion sleeve 14.

In this embodiment, the cushion sleeve 14 is also made of soft materials such as rubber and thus is comfortable for the user to wear.

Apparently, the preceding embodiments of the present disclosure are merely illustrative examples which are not intended to limit the implementations of the present disclosure. For those of ordinary skill in the art, changes or alterations in other different forms can be made based on the above description. Implementations of the present disclosure cannot be and do not need to be exhausted herein, however. Any modifications, equivalent substitutions, improvements and the like made in accordance with the spirit and principles of the present disclosure should all fall in the scope of protection of the present disclosure.

What is claimed is:

1. A bone conduction earphone, comprising:

a main body;

a bone conduction speaker mounted on the main body; and passive radiators mounted on the main body, wherein the passive radiators are connected to the bone conduction speaker through connecting rods, and the bone conduction speaker is operative to vibrate when being excited by an audio signal and drive the passive radiators to vibrate synchronously through the connecting rods;

wherein a number of the passive radiators are even, every two of the passive radiators form one set and are symmetrically disposed about the bone conduction speaker, and each set of the passive radiators are connected to the bone conduction speaker through one of the connecting rods, wherein two ends of the one of the connecting rods are respectively connected to the two passive radiators of a corresponding set, and a center of the one of the connecting rods is connected to the bone conduction speaker.

2. The bone conduction earphone of claim 1, wherein the main body comprises:

a base, wherein the bone conduction speaker and the passive radiators are mounted on the base; and a hook, detachably connected to the base and operative to be hooked around a periphery of a human ear and cooperate with the bone conduction speaker to clamp the human ear.

3. The bone conduction earphone of claim 2, wherein of the hook and the base one is provided with an insertion slot and a seizing hole that passes through a side wall of the insertion slot, and the other is provided with an insertion rod and a locking protrusion connected to an outer wall of the insertion rod, wherein the insertion rod is operative to be inserted in the insertion slot, and the locking protrusion is operative to be caught in the seizing hole.

4. The bone conduction earphone of claim 3, wherein an opening of the insertion slot is provided with a limiting slot passing through a side wall of the insertion slot, and the outer wall of the insertion rod is provided with a limiting protrusion, wherein the limiting protrusion is operative to be inserted in the limiting slot.

5. The bone conduction earphone of claim 2, wherein the base comprises a bottom housing and a cover, an opening of the bottom housing faces away from the hook, the cover is connected to the bottom housing and covers the opening of the bottom housing, the bottom housing is provided with an active acoustic aperture and passive acoustic apertures, wherein the bone conduction speaker is mounted in the active acoustic aperture, and the passive radiators are mounted in the passive acoustic apertures respectively.

6. The bone conduction earphone of claim 2, wherein the hook is rod-shaped and comprises a first arc segment and a second arc segment connected to each other, wherein a free end of the first arc segment is connected to the base, the first arc segment is bent toward the base and operative to be hooked around the periphery of the human ear, the second arc segment is bent away from the base, and an outer side surface of the second arc segment abuts against the bone conduction speaker.

7. The bone conduction earphone of claim 6, wherein the main body further comprises a cushion strip connected to the hook and extending from an inner side surface of the first arc segment to the outer side surface of the second arc segment, and the first arc segment is operative to be hooked around the periphery of the human ear through the cushion strip.

8. The bone conduction earphone of claim 6, wherein the main body further comprises a cushion sleeve sleeved on the second arc segment, and the outer side surface of the second arc segment abuts against the bone conduction speaker through the cushion sleeve.

* * * * *